US011248550B2

(12) United States Patent
Sasaki et al.

(10) Patent No.: US 11,248,550 B2
(45) Date of Patent: Feb. 15, 2022

(54) INTERNAL COMBUSTION ENGINE CONTROL DEVICE

(71) Applicant: HONDA MOTOR CO., LTD., Tokyo (JP)

(72) Inventors: Ryo Sasaki, Tochigi (JP); Takahiro Kashima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 202 days.

(21) Appl. No.: 16/497,028

(22) PCT Filed: Mar. 13, 2018

(86) PCT No.: PCT/JP2018/009733
§ 371 (c)(1),
(2) Date: Sep. 24, 2019

(87) PCT Pub. No.: WO2018/180466
PCT Pub. Date: Oct. 4, 2018

(65) Prior Publication Data

US 2020/0370493 A1 Nov. 26, 2020

(30) Foreign Application Priority Data

Mar. 27, 2017 (JP) ..... JP2017-060936

(51) Int. Cl.
*F02D 41/06* (2006.01)
*F02M 51/06* (2006.01)
*F02D 41/20* (2006.01)

(52) U.S. Cl.
CPC ..... *F02D 41/064* (2013.01); *F02D 41/068* (2013.01); *F02M 51/06* (2013.01); (Continued)

(58) Field of Classification Search
CPC ..... F02D 41/064; F02D 41/068; F02D 2041/2065; F02D 2200/021; F02D 2200/06; F02D 2200/70; F02M 51/06
(Continued)

(56) References Cited

U.S. PATENT DOCUMENTS 4,082,066 A * 4/1978 Long ..... F02D 41/32 123/478
2008/0072879 A1 3/2008 Nagase et al.
(Continued)

FOREIGN PATENT DOCUMENTS

JP 2000-073901 A 3/2000
JP 2008-086119 A 4/2008
(Continued)

OTHER PUBLICATIONS

JP6739317B2 (Sasaki Akira) (Aug. 12, 2020) (Machine Translation) Retrieved fro Dialog on Jun. 8, 2021 (Year: 2020).*
(Continued)

*Primary Examiner* — Mahmoud Gimie
(74) *Attorney, Agent, or Firm* — Carrier Blackman & Associates, P.C.; Joseph P. Carrier; Jeffrey T. Gedeon

(57) ABSTRACT

An internal combustion engine control device (1) includes an injector-temperature calculation unit (21*a*), an engine-temperature calculation unit (21*b*), an operating-state control unit (21*c*), a cold/warmed-up state determination unit (21*d*), an ambient-temperature calculation unit (21*e*), and a correction unit (21*f*). The correction unit (21*f*) corrects an engine temperature calculated based on an injector temperature, when it is determined that an engine is in a cold state and a difference between the injector temperature and an ambient temperature is equal to or larger than a first predetermined value.

4 Claims, 4 Drawing Sheets

(52) U.S. Cl.
CPC ..... *F02D 2041/2065* (2013.01); *F02D 2200/021* (2013.01); *F02D 2200/06* (2013.01); *F02D 2200/70* (2013.01)

(58) Field of Classification Search
USPC ..... 701/113
See application file for complete search history.

(56) References Cited

U.S. PATENT DOCUMENTS

| | | | | |
|---|---|---|---|---|
| 2010/0125400 | A1 * | 5/2010 | Mc Donald ..... | F02D 41/40 701/103 |
| 2015/0198129 | A1 | 7/2015 | Dangelmaier et al. | |

FOREIGN PATENT DOCUMENTS

| | | | | | |
|---|---|---|---|---|---|
| JP | 2012-246821 | A | 12/2012 | | |
| JP | 2016-098665 | A | 5/2016 | | |
| JP | 2016-176346 | A | 10/2016 | | |
| JP | 2016-211444 | A | 12/2016 | | |
| JP | 2016-223291 | A | 12/2016 | | |
| JP | 6739317 | B2 * | 8/2020 | ..... | F02D 45/00 |
| WO | 2014/171491 | A1 | 10/2014 | | |
| WO | WO-2014171491 | A1 * | 10/2014 | ..... | F02D 37/02 |

OTHER PUBLICATIONS

Extended European search report issued in the counterpart EP Patent Application No. 18777388.2 dated Feb. 11, 2020.
Supplementary European search report issued in the counterpart EP Patent Application No. 18777388.2 dated Feb. 28, 2020.

* cited by examiner

INTERNAL COMBUSTION ENGINE CONTROL DEVICE

TECHNICAL FIELD

The present invention relates to an internal combustion engine control device, and more particularly relates to an internal combustion engine control device that is applied to a general-purpose machine such as a power generator or a vehicle such as a two-wheeled automobile.

BACKGROUND ART

In recent years, in a general-purpose machine such as a power generator or a vehicle such as a small two-wheeled automobile, since it becomes difficult in a carburetor system to meet the exhaust gas regulation that becomes tougher in the future, adoption of a fuel injection system has been promoted in order to reduce exhaust gas. However, the selling price of the general-purpose machine such as the power generator or the vehicle such as the small two-wheeled automobile is more inexpensive than the selling prices of a large two-wheeled automobile and a four-wheeled automobile. Therefore, when considering the selling price, it is difficult to adopt the fuel injection system as it is, whose cost is higher than that of the carburetor system, for the general-purpose machine such as the power generator or the vehicle such as the small two-wheeled automobile. Accordingly, in the general-purpose machine such as the power generator or the vehicle such as the small two-wheeled automobile, cost reduction has been demanded for components related to the fuel injection system, particularly, for sensors.

For example, a temperature sensor in the fuel injection system is generally used to detect a warmed-up state of an internal combustion engine. Specifically, the fuel injection system calculates a temperature of the internal combustion engine based on an output of the temperature sensor and detects the warmed-up state of the internal combustion engine based on the temperature of the internal combustion engine calculated in this way, to control an ignition timing and fuel injection. Therefore, when a fuel injection system is to be adopted, the temperature sensor needs to be attached to the internal combustion engine. Furthermore, when the temperature sensor is installed in the internal combustion engine, wires or couplers for interconnection need to be installed and a portion of the internal combustion engine where the temperature sensor is to be installed needs to be processed. As a result, the ratio of the cost of the fuel injection system in the selling price becomes higher than that of the carburetor system. Accordingly, particularly in an internal combustion engine control device that controls the fuel injection system in a general-purpose machine such as a power generator or a vehicle such as a small two-wheeled automobile, omission of the temperature sensor from the fuel injection system is demanded to reduce the cost.

Under such circumstances, Patent Literature 1 relates to an electronic control device 20 of an engine 10, and discloses a configuration in which a temperature of the engine 10 is calculated based on a temperature of an injector 15 to control the engine 10 based on the calculated temperature of the engine 10, focusing on a correlation between the temperature of the injector 15 and the temperature of the engine 10.

PRIOR ART DOCUMENT

Patent Document

Patent Document 1: Japanese Patent Application Laid-open No. 2016-98665

SUMMARY OF THE INVENTION

Problem to be Solved by the Invention

However, according to the studies made by the present inventors, when an internal combustion engine starts up from a cold state, a fuel injection amount is corrected to be increased, and if full-throttle running is performed immediately after start-up, drive of the injector is further increased. Accordingly, such a case can be considered that a self-generated heat amount of the injector increases to raise the temperature of the injector (injector temperature) to a value more than that for maintaining an appropriate correlation with the temperature of the internal combustion engine (internal combustion engine temperature). Under such circumstances, if the internal combustion engine is stopped and restarted immediately thereafter before the engine temperature rises, since the injector temperature is high, the engine temperature estimated based on the injector temperature becomes higher than the actual engine temperature, thereby causing a deviation therebetween. If the engine temperature estimated in this way is used as it is for calculation of the fuel injection amount, a fuel injection amount smaller than an appropriate fuel injection amount is calculated. If the small fuel injection amount is applied, deterioration of drivability can be considered as a result thereof.

Further, according to the studies made by the present inventors, if the internal combustion engine is started up and stopped after warming-up thereof is completed, the injector is warmed by the heat generated by the internal combustion engine. Therefore, such a case can be considered that the appropriate correlation between the injector temperature and the engine temperature collapses. In such a case, a deviation between the estimated temperature of the internal combustion engine and the actual temperature thereof occurs. Therefore, it can be also considered that the drivability deteriorates similarly when the internal combustion engine is started again in a mid warmed-up state before the internal combustion engine is completely cooled down.

The present invention has been achieved through the above studies, and an object of the present invention is to provide an internal combustion engine control device that can suppress that the internal combustion engine temperature calculated based on the injector temperature deviates from the actual internal combustion engine temperature, even if the injector temperature deviates from a value showing an appropriate correlation with the internal combustion engine temperature at the time of restarting an internal combustion engine.

Means for Solving the Problem

In order to achieve the above object, a first aspect of the present invention provides an internal combustion engine control device applied to an internal combustion engine, the internal combustion engine control device comprising: an injector-temperature calculation unit that calculates an injector temperature based on a coil resistance value of an injector; an internal-combustion-engine temperature calculation unit that calculates a temperature of the internal combustion engine based on the injector temperature; and an operating-state control unit that controls an operating state of the internal combustion engine based on the temperature of the internal combustion engine calculated by the internal-combustion-engine temperature calculation unit, wherein the internal combustion engine control device further comprises: a cold/warmed-up state determination unit that determines whether the internal combustion engine is in a cold state or a warmed-up state; an ambient-temperature calculation unit that calculates an ambient temperature around the internal combustion engine control device; and a correction unit that corrects the temperature of the internal combustion engine calculated based on the injector temperature, when it is determined that the internal combustion engine is in the cold state and a difference between the injector temperature and the ambient temperature is equal to or larger than a first predetermined value.

According to a second aspect of the present invention, in addition to the first aspect, the correction unit calculates an initial value of a correction amount for correcting the temperature of the internal combustion engine based on a relative relation with respect to the difference between the injector temperature and the ambient temperature, and decreases the correction amount with a passage of time since start-up of the internal combustion engine.

According to a third aspect of the present invention, in addition to the first or second aspect, the internal combustion engine control device further comprises a first temperature sensor and a second temperature sensor respectively placed correspondingly to a first position and a second position at which a temperature difference occurs therebetween when the internal combustion engine control device is driven, and when a difference between a first temperature detected by the first temperature sensor and a second temperature detected by the second temperature sensor is equal to or smaller than a second predetermined value, the cold/warmed-up state determination unit determines that the internal combustion engine is in the cold state.

Effect of the Invention

According to the internal combustion engine control device of the first aspect of the present invention, when a difference between the injector temperature and the ambient temperature is large even if the internal combustion engine is in a cold state, the correction unit determines that only the injector temperature is high to appropriately correct the temperature of the internal combustion engine calculated based on the injector temperature. Accordingly, even if the injector temperature deviates from a value having an appropriate correlation with the temperature of the internal combustion engine at the time of restarting the internal combustion engine, it can be suppressed that the temperature of the internal combustion engine calculated based on the injector temperature deviates from the actual temperature of the internal combustion engine.

According to the internal combustion engine control device of the second aspect of the present invention, the correction unit decreases the correction amount, taking into consideration a fact that the actual temperature of the internal combustion engine rises with the passage of time since start-up of the internal combustion engine, and the correlation thereof with the injector temperature approaches a correlation stored in a storage medium. Accordingly, the temperature of the internal combustion engine can be corrected appropriately.

According to the internal combustion engine control device of the third aspect of the present invention, the internal combustion engine control device uses the first temperature sensor and the second temperature sensor respectively placed correspondingly to the first position and the second position at which a temperature difference occurs therebetween when the internal combustion engine control device is driven. When the difference between the first temperature detected by the first temperature sensor and the second temperature detected by the second temperature sensor is equal to or smaller than the second predetermined value, the cold/warmed-up state determination unit determines that the internal combustion engine is in the cold state. Accordingly, the cold/warmed-up state of the internal combustion engine can be determined appropriately without installing a temperature sensor separately in the internal combustion engine.

EMBODIMENT FOR CARRYING OUT THE INVENTION

An internal combustion engine control device according to an embodiment of the present invention will be explained below in detail with reference to the accompanying drawings.

[Configuration of Internal Combustion Engine Control Device]

Figure 1A:
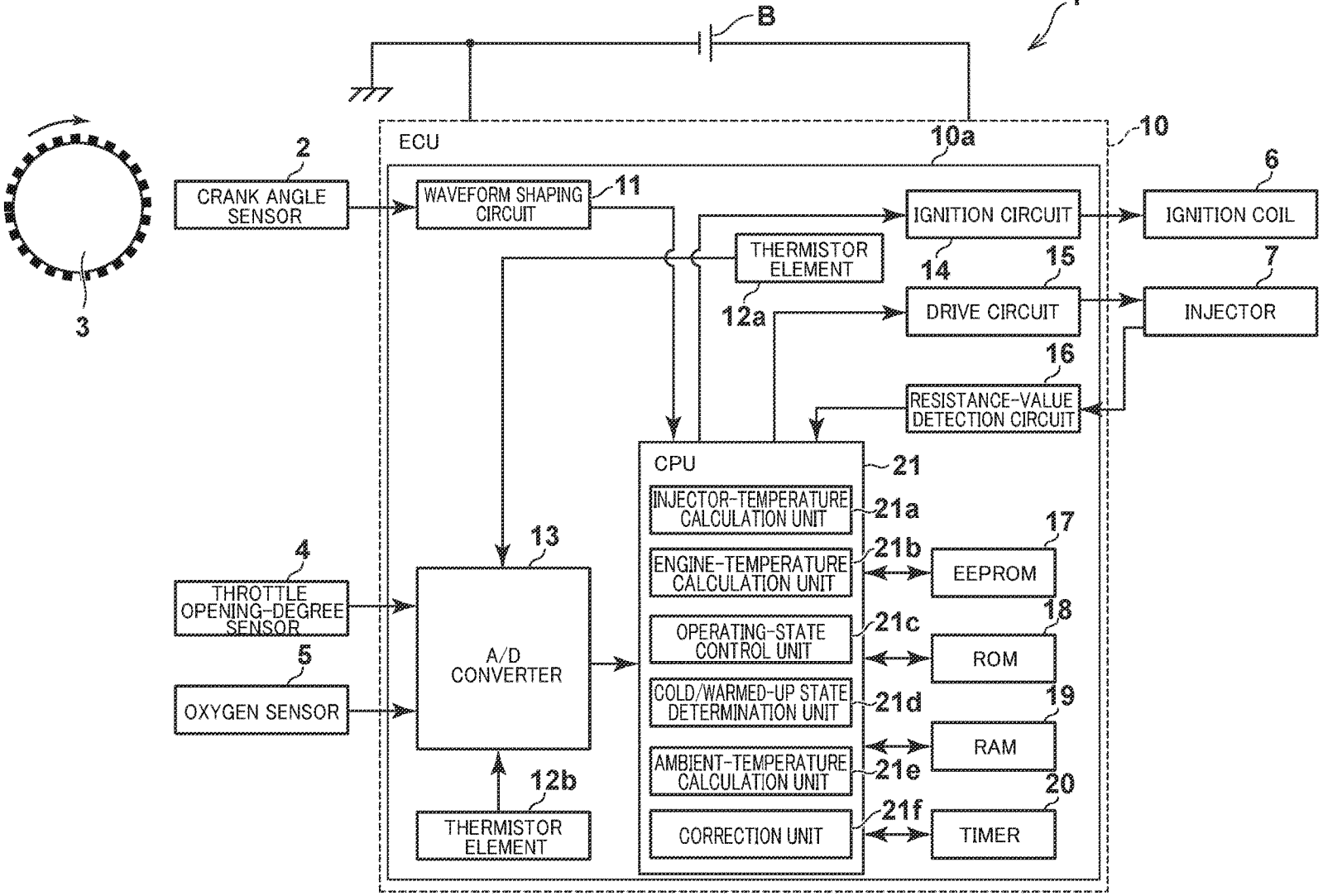
FIG. 1A is a schematic diagram showing a configuration of an internal combustion engine control device according to an embodiment of the present invention.
Figure 1B:
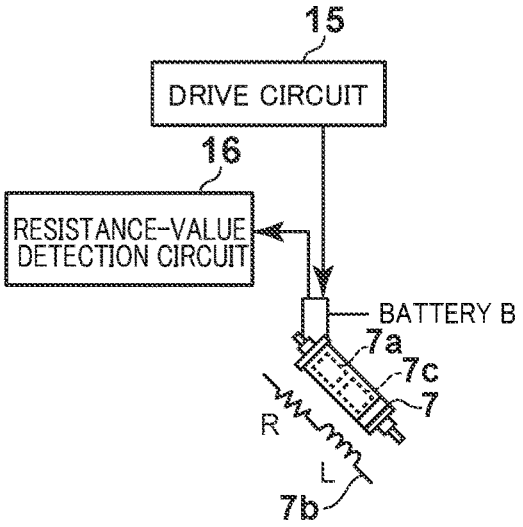
FIG. 1B is a schematic diagram showing a configuration of an injector in FIG. 1A.

A configuration of an internal combustion engine control device according to the present embodiment is explained first with reference to FIGS. 1A and 1B. While the internal combustion engine control device according to the present embodiment is typically preferably mounted on an internal combustion engine mount body, for example, a general-purpose machine such as a power generator or a vehicle such as a two-wheeled automobile, the present embodiment is explained below assuming the internal combustion engine control device is mounted on a vehicle such as a two-wheeled automobile for the sake of convenience.

FIG. 1A is a schematic diagram showing a configuration of the internal combustion engine control device according to the present embodiment, and FIG. 1B is a schematic diagram showing a configuration of an injector in FIG. 1A.

As shown in FIGS. 1A and 1B, an internal combustion engine control device 1 according to the present embodiment controls the operating state of an engine being an internal combustion engine such as a gasoline engine mounted on a vehicle (all not shown) on the basis of the temperature of a functional equipment of the engine, and includes an electronic control unit (ECU) 10.

The ECU 10 operates with power from a battery B mounted on the vehicle and includes a waveform shaping circuit 11, thermistor elements 12*a* and 12*b*, an A/D converter 13, an ignition circuit 14, a drive circuit 15, a resistance-value detection circuit 16, an EEPROM (Electrically Erasable Programmable Read-Only Memory) 17, a ROM (Read-Only Memory) 18, a RAM (Random Access Memory) 19, a timer 20, and a central processing unit (CPU) 21. These constituent elements of the ECU 10 are housed in a body 10*a* of the ECU 10. Typically, the ECU 10 and the engine are in contact with outside air on the respective peripheries and the ECU 10 is placed away from the engine so as not to be affected by radiant heat of the engine and heat transfer from the engine.

The waveform shaping circuit 11 shapes a crank pulse signal corresponding to a rotation angle of a crankshaft 3 of the engine, which is output from a crank angle sensor 2, to generate a digital pulse signal. The waveform shaping circuit 11 outputs the digital pulse signal generated in this way to the CPU 21.

The thermistor element 12*a* (a thermistor B) is a chip thermistor placed in a region where the temperature becomes highest in the body 10*a* of the ECU 10 (in a region being close to a heating element, which is typically the ignition circuit 14, and at a distance of about several millimeters to the heating element), and outputs an electric signal having an electric resistance value corresponding to the temperature and indicating a voltage corresponding to the electric resistance value to the A/D converter 13. The thermistor element 12*a* can be replaced by other temperature sensors such as a thermocouple, as long as the temperature sensors can output the electric signal as described above.

The thermistor element 12*b* (a thermistor A) is a chip thermistor placed in a region where the temperature most approaches an ambient temperature (an outside air temperature) being an atmosphere temperature around the outside of the body 10*a* of the ECU 10, that is, the ambient temperature (the outside air temperature) being the atmosphere temperature around the engine, in the body 10*a* of the ECU 10 (typically, in a region being close to the body 10*a*, and at a distance of about several millimeters to the body 10*a*), and outputs an electric signal having an electric resistance value corresponding to the temperature and indicating a voltage corresponding to the electric resistance value to the A/D converter 13. The thermistor element 12*b* can be replaced by other temperature sensors such as a thermocouple, as long as the temperature sensors can output the electric signal as described above.

The A/D converter 13 converts each of an electric signal that indicates an opening degree of a throttle valve of the engine and that is output from a throttle opening-degree sensor 4, an electric signal that indicates an oxygen concentration in the atmosphere absorbed by the engine and that is output from an oxygen sensor 5, and the electric signals output from the thermistor elements 12*a* and 12*b* from an analog form into a digital form. The A/D converter 13 outputs these electric signals having been converted into the digital form in this way to the CPU 21.

The ignition circuit 14 includes a switching element such as a transistor that is controlled to be on/off in accordance with a control signal from the CPU 21. The switching element performs an on/off operation to control the operation of an ignition coil 6 that generates a secondary voltage for igniting a mixture including fuel and air in the engine via a sparking plug (not shown). The ignition circuit 14 is typically a driver IC (Integrated Circuit) being a semiconductor element and is a constituent element generating a largest amount of heat in the body 10*a*.

The drive circuit 15 includes a switching element such as a transistor that is controlled to be on/off in accordance with a control signal from the CPU 21, and the switching element performs an on/off operation to switch between energized and non-energized states of a coil 7*a* of an injector 7 that supplies fuel to the engine. The injector 7 is attached to an air intake pipe or a cylinder head (both not shown) of the engine and heat generated by the engine is transferred to the injector 7. As particularly shown in FIG. 1B, an equivalent circuit 7*b* of the coil 7*a* of the injector 7 is represented by a series circuit including an inductance component L and an electric resistance component R. The coil 7*a* is a constituent part for electrically driving a solenoid 7*c* of the injector 7 and the solenoid 7*c* operates in an energized state of the coil 7*a*, so that the fuel is injected from the injector 7.

The resistance-value detection circuit 16 measures an electric resistance value (a resistance value) being a physical amount that fluctuates depending on the electric resistance component R of the coil 7*a* of the injector 7, and outputs an electric signal indicating the resistance value measured in this way to the CPU 21.

The EEPROM 17 has stored therein data related to various learned values such as a fuel-injection-amount learned value and a throttle-reference-position learned value. The EEPROM 17 can be replaced by other storage media such as a data flash, as long as the media can store therein data or the like related to these various learned values.

The ROM 18 is constituted by a non-volatile storage device and has stored therein various types of control data such as control programs for subtraction-amount calculation processing of an engine temperature at the time of restart, injector temperature table data, table data showing a correlation characteristic line of a differential temperature of the thermistors, table data defining an initial value of a subtraction amount of the engine temperature, and engine temperature table data, which will be described later.

The RAM 19 is constituted by a volatile storage device and functions as a working area of the CPU 21.

The timer 20 performs timing processing in accordance with a control signal from the CPU 21.

The CPU 21 controls the entire operation of the ECU 10. In the present embodiment, the CPU 21 functions as an injector-temperature calculation unit 21*a*, an engine-temperature calculation unit 21*b*, an operating-state control unit 21*c*, a cold/warmed-up state determination unit 21*d*, an ambient-temperature calculation unit 21*e*, and a correction unit 21*f* by executing control programs stored in the ROM 18. The injector-temperature calculation unit 21*a* calculates the temperature of the injector 7 (injector temperature) corresponding to the resistance value of the coil 7*a* of the injector 7. The engine-temperature calculation unit 21*b* calculates the temperature of the engine (engine temperature) based on the injector temperature calculated by the injector-temperature calculation unit 21*a*. The operating-state control unit 21*c* controls the ignition circuit 14 and the drive circuit 15 based on the engine temperature calculated by the engine-temperature calculation unit 21*b* to control the operating state of the engine. The cold/warmed-up state determination unit 21*d* determines whether the engine is in a cold state or in a warmed-up state. The ambient-temperature calculation unit 21*e* calculates the ambient temperature (the outside air temperature) being the atmosphere temperature around the outside of the body 10*a* of the ECU 10, that is, the ambient temperature (the outside air temperature) around the engine. Further, when the cold/warmed-up state determination unit 21*d* determines that the engine is in the cold state and a difference between the injector temperature calculated by the injector-temperature calculation unit 21*a* and the ambient temperature calculated by the ambient-temperature calculation unit 21*e* is equal to or larger than a predetermined value (a first predetermined value), the correction unit 21*f* corrects the engine temperature calculated by the engine-temperature calculation unit 21*b*.

The injector temperature is cited as a preferred example of the temperature of a functional equipment of the engine from a viewpoint of ease of the measurement and the like. However, other functional devices can be used as the functional equipment of the engine as long as the functional devices can measure the resistance value corresponding to the engine temperature, and the temperature of the functional devices can be used as the temperature of the functional equipment of the engine. When the engine temperature correlated with the injector temperature is to be acquired, it is easy that the temperature of a spark plug seat of the engine is actually measured to acquire the engine temperature in view of a fact that the temperature of the spark plug seat of the engine is close to the actual temperature of the inside of the engine.

A deviation that may occur between the calculated engine temperature (an estimated engine temperature before correction) and the actual engine temperature (real engine temperature), which should be taken into consideration at the time of calculating the engine temperature based on the injector temperature, is explained with reference to FIG. 2.

Figure 2:
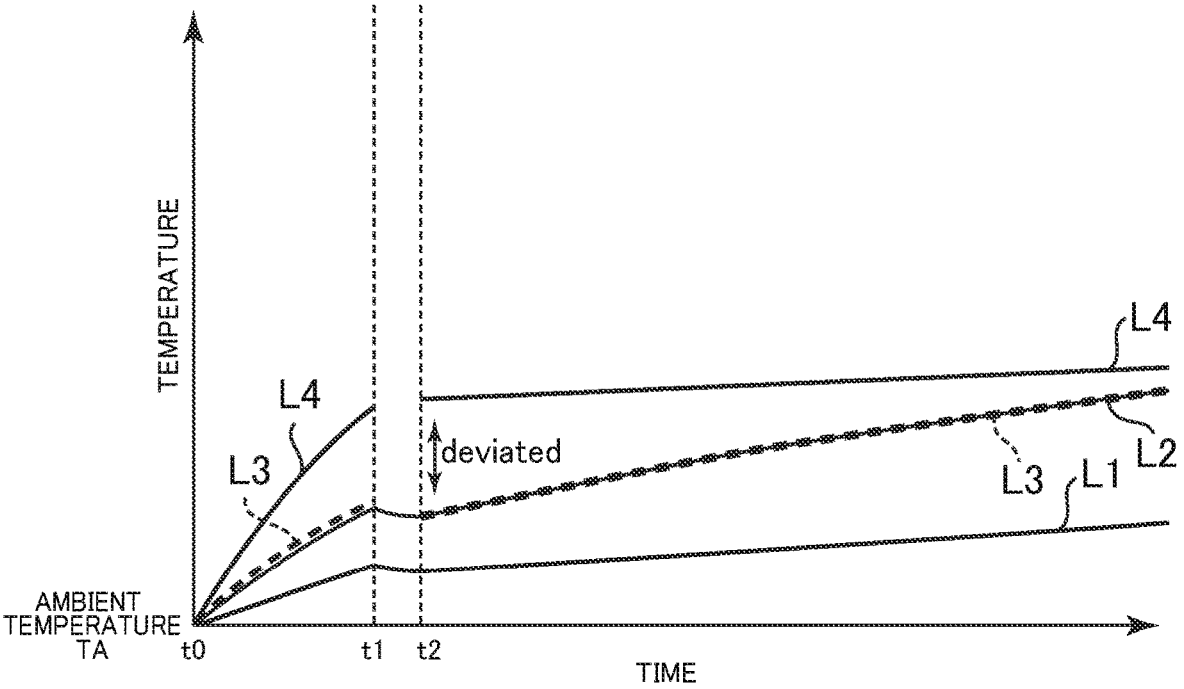
FIG. 2 is a diagram showing an example of temporal changes of an injector temperature, an actual engine temperature, an estimated engine temperature before correction and an estimated engine temperature after correction, in a case where an internal combustion engine, to which the internal combustion engine control device according to the present embodiment is applied, starts up from a cold state.

FIG. 2 is a diagram showing an example of temporal changes of an injector temperature L1, a real engine temperature L2, an estimated engine temperature after correction L3 (indicated by a broken line), and an estimated engine temperature before correction L4, in a case where the engine, to which the internal combustion engine control device 1 according to the present embodiment is applied, starts up from the cold state.

As shown in FIG. 2, when the engine starts up from the cold state (time t=t0), since the fuel injection amount is corrected to be increased, the drive of the injector 7 is increased. Further, if full-throttle running is performed immediately after start-up, the drive of the injector is further increased. Accordingly, there is a possibility that a self-generated heat amount of the injector 7 increases to raise the injector temperature L1 to a value more than a value having an appropriate correlation with the real engine temperature L2. Under such circumstances, if the engine stops (time t=t1) before warming-up of the engine is completed and the engine is restarted immediately thereafter (time t=t2), since the injector temperature L1 is higher than the value having the appropriate correlation with the real engine temperature, the engine temperature (the estimated engine temperature before correction L4) estimated based on the injector temperature L1 becomes higher than the real engine temperature L2, thereby causing a deviation therebetween. If the engine temperature estimated in this way (the estimated engine temperature before correction L4) is used as it is for calculation of the fuel injection amount, a fuel injection amount smaller than an appropriate fuel injection amount is calculated, thereby causing deterioration of the drivability.

Therefore, the internal combustion engine control device 1 according to the present embodiment performs the subtraction-amount calculation processing of an engine temperature at the time of restart described below, to correct the engine temperature calculated based on the injector temperature L1 (the estimated engine temperature before correction L4) to the estimated engine temperature after correction L3, when a difference between the injector temperature L1 and an ambient temperature TA is equal to or larger than the predetermined value (the first predetermined value). Accordingly, even if the injector temperature L1 has risen to a value having the appropriate correlation with the real engine temperature L2 at the time of restart of the engine, it can be suppressed that the engine temperature calculated based on the injector temperature L1 (the estimated engine temperature after correction L3) deviates from the real engine temperature L2. A case where the engine is restarted immediately after the engine has stopped before completion of warming-up of the engine and a case where the engine is restarted in the mid warmed-up state before the engine becomes a completely cold state after the engine has stopped can be cited as typical examples in which the injector temperature L1 deviates from the value having the appropriate correlation with the real engine temperature L2 at the time of restart of the engine.

Figure 3:
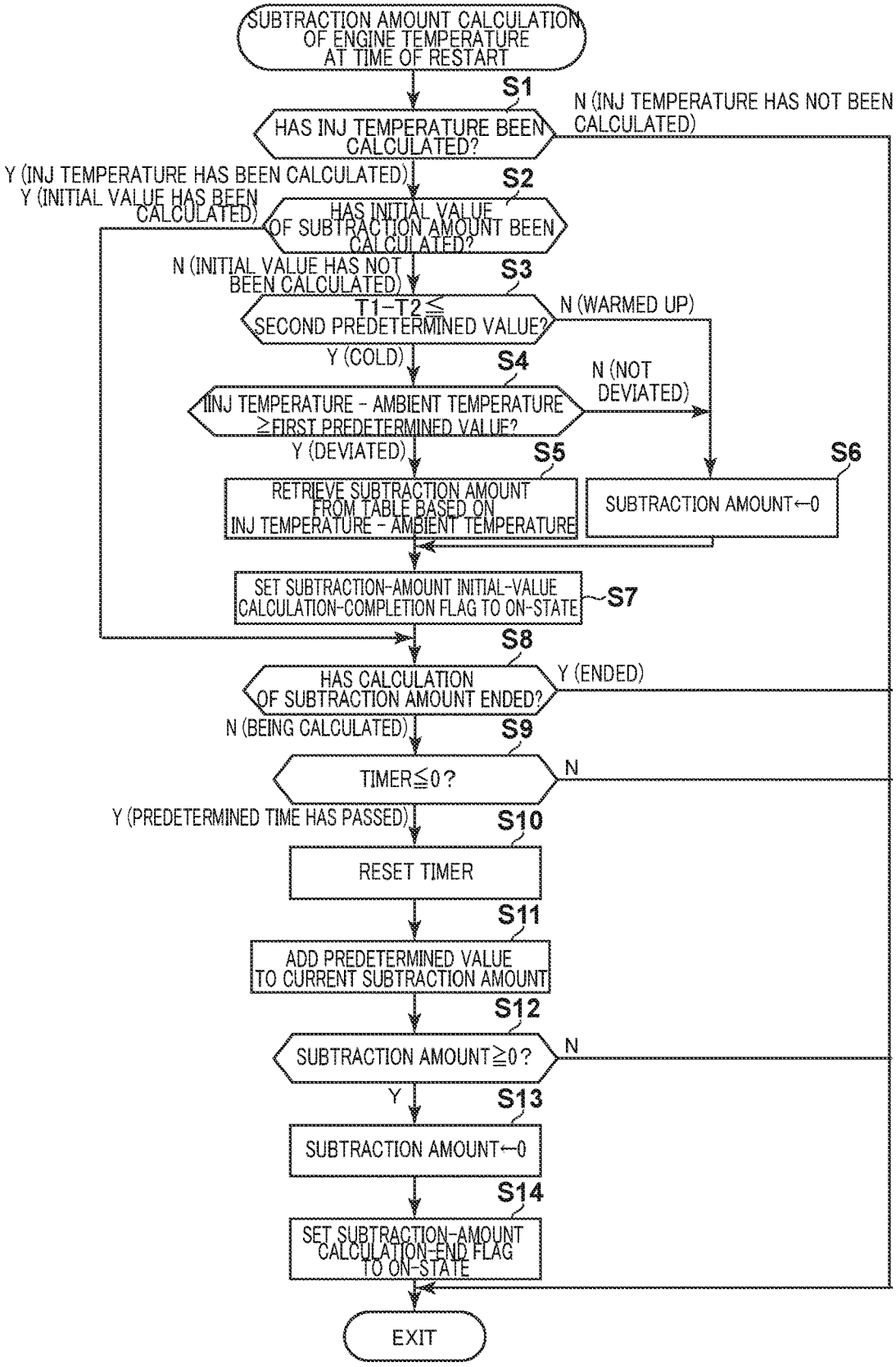
FIG. 3 is a flowchart showing a flow of subtraction-amount calculation processing of an engine temperature at the time of restart performed by the internal combustion engine control device according to the present embodiment.
Figure 4:
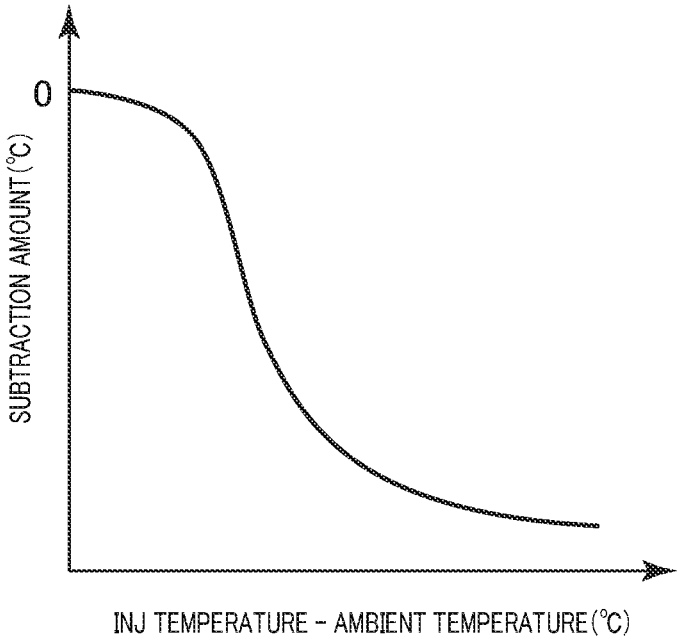
FIG. 4 is a diagram showing an example of table data representing a relation between a difference between the injector temperature and the ambient temperature and the subtraction amount of the engine temperature to be used in the subtraction-amount calculation processing of an engine temperature at the time of restart performed by the internal combustion engine control device according to the present embodiment.

An operation of the internal combustion engine control device 1 at the time of performing the subtraction-amount calculation processing of an engine temperature at the time of restart according to the present embodiment is explained more specifically, also with reference to FIG. 3 and FIG. 4. A case where the engine is restarted immediately after the engine has stopped before completion of warming-up of the engine is assumed here.

[Subtraction-Amount Calculation Processing of Engine Temperature at Time of Restart]

FIG. 3 is a flowchart showing a flow of the subtraction-amount calculation processing of an engine temperature at the time of restart performed by the internal combustion engine control device 1 according to the embodiment of the present invention. FIG. 4 is a diagram showing an example of table data representing a relation between a difference between the injector temperature (INJ temperature) and the ambient temperature and the subtraction amount of the engine temperature to be used in the subtraction-amount calculation processing of an engine temperature at the time of restart.

The flowchart shown in FIG. 3 is a flowchart of the subtraction-amount calculation processing of an engine temperature at the time of restart performed as one of the processing for calculating the fuel injection amount in the internal combustion engine control device, which starts at a timing when the ignition switch of a vehicle is switched from an off-state to an on-state and the CPU 21 operates. When the fuel-injection-amount calculation processing proceeds to the subtraction-amount calculation processing of an engine temperature at the time of restart, a process at Step S1 is performed. This subtraction-amount calculation processing of an engine temperature at the time of restart is repeatedly performed for each predetermined control period while the ignition switch of the vehicle is in the on-state and the CPU 21 is operating.

In the process at Step S1, the correction unit 21*f* discriminates whether the injector temperature (INJ temperature) has been calculated by referring to an injector-temperature calculation-completion flag or the like. When a result of the discrimination indicates that the injection temperature has been calculated (YES at Step S1), the injector-temperature calculation unit 21*a* causes the subtraction-amount calculation processing of an engine temperature at the time of restart to proceed to a process at Step S2. On the other hand, when the injector temperature has not been calculated (NO at Step S1), the injector-temperature calculation unit 21*a* ends this series of subtraction-amount calculation processing of an engine temperature at the time of restart.

The injector temperature here is typically calculated by the injector-temperature calculation unit 21*a* correspondingly to a resistance value of the injector 7 (INJ resistance value) detected via the resistance-value detection circuit 16. At this time, the injector-temperature calculation unit 21*a* needs only to calculate the injector temperature by retrieving a value of the injector temperature corresponding to the resistance value of the injector 7 detected in this way, for example, from an injector temperature table indicating a relation between the resistance value of the injector 7 and the value of the injector temperature, which has been stored beforehand in the ROM 18.

In the process at Step S2, the correction unit 21*f* discriminates whether an initial value of the subtraction amount (a negative value) has been calculated as a correction amount for correcting the engine temperature, by discriminating whether a subtraction-amount initial-value calculation-completion flag is in an on-state. When a result of the discrimination indicates that the subtraction-amount initial-value calculation-completion flag is in the on-state (YES at Step S2), the correction unit 21*f* determines that the initial value of the subtraction amount has been calculated, and causes the subtraction-amount calculation processing of an engine temperature at the time of restart to proceed to a process at Step S8. On the other hand, when the subtraction-amount initial-value calculation-completion flag is not in the on-state (NO at Step S2), the correction unit 21*f* determines that the initial value of the subtraction amount has not been calculated, and causes the subtraction-amount calculation processing of an engine temperature at the time of restart to proceed to a process at Step S3.

In the process at Step S3, the cold/warmed-up state determination unit 21*d* discriminates whether a difference between a detection temperature T1 of the thermistor element 12*a* (the thermistor B) and a detection temperature T2 of the thermistor element 12*b* (the thermistor A) is equal to or smaller than a second predetermined value. When a result of the discrimination indicates that the difference is equal to or smaller than the second predetermined value (YES at Step S3), the cold/warmed-up state determination unit 21*d* determines that the engine is in the cold state, and causes the subtraction-amount calculation processing of an engine temperature at the time of restart to proceed to a process at Step S4. On the other hand, when the difference is not equal to or smaller than the second predetermined value (NO at Step S3), the cold/warmed-up state determination unit 21*d* determines that the engine is in the warmed-up state, and causes the subtraction-amount calculation processing of an engine temperature at the time of restart to proceed to a process at Step S6.

In the process at Step S4, the ambient-temperature calculation unit 21*e* calculates an ambient temperature (an outside air temperature) being an atmosphere temperature around the outside of the body 10*a* of the ECU 10. The correction unit 21*f* then discriminates whether a difference between the injector temperature and the ambient temperature is equal to or larger than the first predetermined value. When a result of discrimination indicates that the difference is equal to or larger than the first predetermined value (YES at Step S4), the correction unit 21*f* determines that a deviation has occurred between the injector temperature and the ambient temperature, and causes the subtraction-amount calculation processing of an engine temperature at the time of restart to proceed to a process at Step S5. On the other hand, when the difference is not equal to or larger than the first predetermined value (NO at Step S4), the cold/warmed-up state determination unit 21*d* determines that a deviation has not occurred between the injector temperature and the ambient temperature, and causes the subtraction-amount calculation processing of an engine temperature at the time of restart to proceed to the process at Step S6.

When the ambient-temperature calculation unit 21*e* calculates the ambient temperature, typically, table data indicating the correlation characteristic line defining beforehand a relation between a first differential temperature ΔT12 obtained by subtracting the detection temperature T2 of the thermistor element 12*b* from the detection temperature T1 of the thermistor element 12*a* and a second differential temperature ΔT2*a* obtained by subtracting the ambient temperature TA from the detection temperature T2 of the thermistor element 12*b* is stored in the ROM 18 beforehand and prepared. The first differential temperature ΔT12 basically corresponds to an amount of heat generation of the ignition circuit 14, that is, an amount of heat generation of the ECU 10. Further, the second differential temperature ΔT2*a* corresponds to a differential temperature between the detection temperature T2 of the thermistor element 12*b* and the ambient temperature TA of the engine, taking into consideration a fact that there is a case where the detection temperature T2 of the thermistor element 12*b* is different from the ambient temperature TA of the engine due to an influence of the amount of heat generation of the ignition circuit 14 or the like.

It suffices that the ambient-temperature calculation unit 21*e* obtains the value of the second differential temperature ΔT2*a* corresponding to the value of the first differential temperature ΔT12 by calculating the first differential temperature ΔT12 and retrieving the table data indicating the correlation characteristic line. Thereafter, it suffices that a value obtained by subtracting the second differential temperature ΔT2*a* from the detection temperature T2 of the thermistor element 12*b* is calculated as the ambient temperature TA of the engine. Accordingly, the practical and accurate ambient temperature TA of the engine can be calculated by excluding the influence of the amount of heat generation of the ECU 10. However, when the influence of the amount of heat generation of the ECU 10 can be practically ignored, it is also possible that the ambient-temperature calculation unit 21*e* calculates the ambient temperature of the engine from the detection temperature of the thermistor element 12*b* by using only the thermistor element 12*b*. Further, when there is a separate sensor that detects the ambient temperature of the engine, it is also possible that the ambient temperature of the engine is calculated from the detection temperature of the sensor.

In the process at Step S5, the correction unit 21*f* calculates the initial value of the subtraction amount of the engine temperature from the difference between the injector temperature and the ambient temperature. Specifically, the correction unit 21*f* retrieves the subtraction amount of the engine temperature corresponding to the difference between the injector temperature and the ambient temperature from the table data as shown in FIG. 4, as an initial value of the subtraction amount. In the table data shown in FIG. 4, the subtraction amount is a negative value and is set such that when the difference between the injector temperature and the ambient temperature is 0, the subtraction amount is 0, and as the difference increases, an absolute value of the subtraction amount increases. Accordingly, the process at Step S5 is completed, and the subtraction-amount calculation processing of an engine temperature at the time of restart proceeds to a process at Step S7.

In the process at Step S6, the correction unit 21*f* sets the initial value of the subtraction amount of the engine temperature to zero. Accordingly, the process at Step S6 is completed, and the subtraction-amount calculation processing of an engine temperature at the time of restart proceeds to the process at Step S7.

In the process at Step S7, the correction unit 21*f* sets the subtraction-amount initial-value calculation-completion flag to the on-state, which indicates whether the initial value of the subtraction amount of the engine temperature has been calculated. Accordingly, the process at Step S7 is completed, and the subtraction-amount calculation processing of an engine temperature at the time of restart proceeds to the process at Step S8.

In the process at Step S8, the correction unit 21*f* discriminates whether a subtraction-amount calculation-end flag is in an on-state, thereby discriminating whether the calculation processing of the subtraction amount of the engine temperature has ended. When a result of discrimination indicates that the subtraction-amount calculation-end flag is in the on-state (YES at Step S8), the correction unit 21*f* determines that the calculation processing of the subtraction amount of the engine temperature has ended, to end this series of subtraction-amount calculation processing of an engine temperature at the time of restart. On the other hand, when the subtraction-amount calculation-end flag is not in the on-state (NO at Step S8), the correction unit 21*f* determines that the calculation processing of the subtraction amount of the engine temperature has not ended, and causes the subtraction-amount calculation processing of an engine temperature at the time of restart to proceed to a process at Step S9.

In the process at Step S9, the correction unit 21*f* discriminates whether a count value of the timer 20 is equal to or smaller than zero, thereby discriminating whether a predetermined time has passed since the previous calculation processing of the subtraction amount. When a result of discrimination indicates that the count value of the timer 20 is equal to or smaller than zero (YES at Step S9), the correction unit 21*f* determines that the predetermined time has passed since the previous calculation processing of the subtraction amount, and causes the subtraction-amount calculation processing of an engine temperature at the time of restart to proceed to a process at Step S10. On the other hand, when the count value of the timer 20 is not equal to or smaller than zero (NO at Step S9), the correction unit 21*f* determines that the predetermined time has not passed since the previous calculation processing of the subtraction amount, and ends this series of subtraction-amount calculation processing of an engine temperature at the time of restart.

In the process at Step S10, the correction unit 21*f* resets the count value of the timer 20. Accordingly, the process at Step S10 is completed, and the subtraction-amount calculation processing of an engine temperature at the time of restart proceeds to a process at Step S11.

In the process at Step S11, the correction unit 21*f* adds a predetermined value to the current subtraction amount of the engine temperature, to decrease the absolute value of the subtraction amount. Accordingly, the process at Step S11 is completed, and the subtraction-amount calculation processing of an engine temperature at the time of restart proceeds to a process at Step S12.

In the process at Step S12, the correction unit 21*f* discriminates whether the subtraction amount is equal to or larger than zero. When a result of discrimination indicates that the subtraction amount is equal to or larger than zero (YES at Step S12), the correction unit 21*f* causes the subtraction-amount calculation processing of an engine temperature at the time of restart to proceed to a process at Step S13. On the other hand, when the subtraction amount is not equal to or larger than zero (NO at Step S12), the correction unit 21*f* ends this series of subtraction-amount calculation processing of an engine temperature at the time of restart.

In the process at Step S13, the correction unit 21*f* sets the subtraction amount of the engine temperature to zero. Accordingly, the process at Step S13 is completed, and the subtraction-amount calculation processing of an engine temperature at the time of restart proceeds to a process at Step S14.

In the process at Step S14, the correction unit 21*f* sets the subtraction-amount calculation-end flag to the on-state. Accordingly, the process at Step S14 is completed, and this series of subtraction-amount calculation processing of an engine temperature at the time of restart ends.

The correction unit 21*f* corrects the engine temperature by adding the subtraction amount calculated in this way to the engine temperature calculated by the engine-temperature calculation unit 21*b*, to calculate the estimated engine temperature after correction L3 shown in FIG. 2. Further, when the engine-temperature calculation unit 21*b* calculates the engine temperature (the estimated engine temperature before correction L4 shown in FIG. 2), typically, the engine-temperature calculation unit 21*b* first corrects the injector temperature calculated by the injector-temperature calculation unit 21*a* by the ambient temperature calculated by the ambient-temperature calculation unit 21*e*. It suffices that the engine-temperature calculation unit 21*b* calculates the engine temperature corresponding to the injector temperature corrected in this way by retrieving the engine-temperature table data defining a relation between the value of the injector temperature corrected in this way and the value of the engine temperature, which has been stored beforehand in the ROM 18. Accordingly, the engine temperature can be calculated in a mode excluding an unnecessary influence of a difference of the ambient temperature of the engine. However, when the difference from the ambient temperature of the engine can be practically ignored, it is also possible that the engine temperature is calculated based on the injector temperature calculated by the injector-temperature calculation unit 21*a* by omitting the correction of the injector temperature by the ambient temperature calculated by the ambient-temperature calculation unit 21*e*.

As is apparent from the above explanations, according to the internal combustion engine control device 1 of the present embodiment, the internal combustion engine control device 1 has a configuration in which the correction unit 21*f* corrects the engine temperature calculated based on the injector temperature, when it is determined that the engine is in the cold state and a difference between the injector temperature and the ambient temperature is equal to or larger than the first predetermined value. Therefore, when the difference between the injector temperature and the ambient temperature is large even if the engine is in the cold state, the correction unit 21*f* can correct the engine temperature calculated based on the injector temperature, by determining that only the injector temperature is high. Accordingly, even if the injector temperature deviates from the value having the appropriate correlation with the engine temperature at the time of restart of the engine, it can be suppressed that the engine temperature calculated based on the injector temperature deviates from the actual engine temperature.

According to the internal combustion engine control device 1 of the present embodiment, the internal combustion engine control device 1 has a configuration in which the correction unit 21*f* calculates the initial value of the correction amount for correcting the engine temperature based on a relative relation with respect to the difference between the injector temperature and the ambient temperature and decreases the correction amount with the passage of time since start-up of the engine. Therefore, the correction amount can be decreased, taking into consideration a fact that the real temperature of the engine rises and the correlation with the injector temperature approaches the value stored in the ROM 18, to correct the engine temperature appropriately.

Further, according to the internal combustion engine control device 1 of the present embodiment, the internal combustion engine control device 1 has such a configuration that when the difference between the detection temperature T1 of the thermistor element 12*a* and the detection temperature T2 of the thermistor element 12*b* is equal to or smaller than the second predetermined value, the cold/warmed-up state determination unit 21*d* determines that the engine is in the cold state, by using the thermistor element 12*a* and the thermistor element 12*b* respectively placed correspondingly to a first position and a second position at which a temperature difference occurs therebetween when the internal combustion engine control device 1 is driven. Therefore, the cold/warmed-up state of the engine can be determined appropriately, without separately providing a temperature sensor to the engine.

In the present invention, the type, form, arrangement, number, and the like of the constituent members are not limited to those in the embodiment explained above, and it is needless to mention that the constituent elements can be modified as appropriate without departing from the scope of the invention, such as appropriately replacing these elements by other ones having identical operational effects.

For example, in the present embodiment, the temperature of the spark plug seat of the engine is used as the engine temperature corresponding to the injector temperature. However, the engine temperature is not limited thereto, and for example, a temperature of an engine cooling water or a temperature of a cylinder wall can be used.

In the table data of the subtraction amount of the engine temperature corresponding to the difference between the injector temperature and the ambient temperature referred to in the process at Step S5 in FIG. 3 in the present embodiment, a negative value is used. However, a positive value can be used. When the subtraction amount is a negative value, the subtraction amount is added to the basic fuel injection amount. However, when the subtraction amount is a positive value, the subtraction amount is subtracted from the basic fuel injection amount.

Further, the configuration of the present embodiment can be used not only for a single-cylinder engine but also for a multi-cylinder engine. In this case, the temperature of each cylinder is estimated from the coil resistance vale of the injector of each cylinder of the multi-cylinder engine, thereby enabling to control the fuel injection amount and the like of each cylinder in accordance with the temperature of each cylinder.

INDUSTRIAL APPLICABILITY

As described above, the present invention can provide an internal combustion engine control device that can suppress that the internal combustion engine temperature calculated based on the injector temperature deviates from the actual engine temperature, even if the injector temperature deviates from a value having an appropriate correlation with the internal combustion engine temperature at the time of restarting an internal combustion engine. Therefore, because of its general purposes and universal characteristics, applications of the present invention can be expected in a wide range in the field of an internal combustion engine control device for a general-purpose machine such as a power generator or a vehicle such as a two-wheeled automobile.

The invention claimed is:

1. An internal combustion engine control device applied to an internal combustion engine, the internal combustion engine control device comprising:

an infector-temperature calculation unit that calculates an injector temperature based on a coil resistance value of an injector; an internal-combustion engine temperature calculation unit that calculates a temperature of the internal combustion engine based on the injector temperature; and an operating-state control unit that controls an operating state of the internal combustion engine based on the temperature of the internal combustion engine calculated by the internal-combustion-engine temperature calculation unit, wherein the internal combustion engine control device further comprises:

a cold/warmed-up state determination unit that determines whether the internal combustion engine is in a cold state or a warmed-up state;

an ambient-temperature calculation unit that calculates an ambient temperature around the internal combustion engine control device; and a correction unit that corrects the temperature of the internal combustion engine calculated based on the injector temperature, when it is determined that the internal combustion engine is in the cold state and a difference between the injector temperature and the ambient temperature is equal to or larger than a first predetermined value.

2. The internal combustion engine control device according to claim 1, wherein the correction unit calculates an initial value of a correction amount for correcting the temperature of the internal combustion engine based on a relative relation with respect to the difference between the injector temperature and the ambient temperature, and decreases the correction amount with a passage of time since start-up of the internal combustion engine.

3. The internal combustion engine control device according to claim 1, wherein the internal combustion engine control device further comprises a first temperature sensor and a second temperature sensor respectively placed correspondingly to a first position and a second position at which a temperature difference occurs therebetween when the internal combustion engine control device is driven, and when a difference between a first temperature detected by the first temperature sensor and a second temperature detected by the second temperature sensor is equal to or smaller than a second predetermined value, the cold/warmed-up state determination unit determines that the internal combustion engine is in the cold state.

4. The internal combustion engine control device according to claim 2, wherein the internal combustion engine control device further comprises a first temperature sensor and a second temperature sensor respectively placed correspondingly to a first position and a second position at which a temperature difference occurs therebetween when the internal combustion engine control device is driven, and when a difference between a first temperature detected by the first temperature sensor and a second temperature detected by the second temperature sensor is equal to or smaller than a second predetermined value, the cold/warmed-up state determination unit determines that the internal combustion engine is in the cold state.

* * * * *